US011024202B2

(12) United States Patent
Canaphany

(10) Patent No.: US 11,024,202 B2
(45) Date of Patent: Jun. 1, 2021

(54) CLIPPED-CLOTH ADVERTISEMENT DISPLAY DEVICE

(71) Applicant: Makitso USA, LLC, Stafford, TX (US)

(72) Inventor: Ralph Canaphany, New South Wales (AU)

( * ) Notice: Subject to any disclaimer, the term of this patent is extended or adjusted under 35 U.S.C. 154(b) by 0 days.

(21) Appl. No.: 16/395,482

(22) Filed: Apr. 26, 2019

(65) Prior Publication Data

US 2020/0066192 A1 Feb. 27, 2020

(51) Int. Cl.
*G09F 7/08* (2006.01)

(52) U.S. Cl.
CPC ..... *G09F 7/08* (2013.01)

(58) Field of Classification Search
CPC ..... G09F 7/08
See application file for complete search history.

(56) References Cited

U.S. PATENT DOCUMENTS 6,261,025 B1 * 7/2001 Husson ..... A47B 47/0041 403/188
7,341,391 B2 * 3/2008 Nakahori ..... F16B 7/0426 403/27
9,303,426 B2 * 4/2016 Workman ..... E04H 15/44
2018/0075787 A1 * 3/2018 Frey ..... G09F 15/0068

* cited by examiner

*Primary Examiner* — Gary C Hoge
(74) *Attorney, Agent, or Firm* — Braxton Perrone, PLLC; Gregory Perrone; Bobby W. Braxton

(57) ABSTRACT

A Silicone Edge Graphics advertisement display device, comprising a plurality of three-pipe joints connected to a plurality of transverse pipes, vertical pipes and grooved pipes. The grooved pipes are v-shaped for receipt of an advertising canvas providing ease of set up and advertising canvas replacement.

11 Claims, 4 Drawing Sheets

CLIPPED-CLOTH ADVERTISEMENT DISPLAY DEVICE

This application claims priority to Chinese Patent Application No. 201821400325.9 filed Aug. 27, 2018 and is incorporated by reference herein in its entirety.

FIELD

Technical Field

The present utility model relates to the technical field of light boxes and, more particularly, to a clipped-cloth advertisement display device.

BACKGROUND

A clipped-cloth light box is made up of an aluminum section frame, high-brightness LED light bars and UV soft films with advertising pictures spray-painted on the soft films. The rims of clipped-cloth light boxes are usually 3 cm, 6 cm, 8 cm, 10 cm or 12 cm wide. The prices of soft films used for clipped-cloth light boxes are expensive and are usually CNY50~120 per square meter, depending on the brand. Method for installing drawing cloth to a clipped-cloth light box: the adhesive bars installed around the cloth are slotted into the grooves in the outer frame of the light box. Its installation is simpler and more convenient compared to stretched-cloth light box. For replacement of drawing cloth, the adhesive bars can be can be conveniently and simply pulled out of the grooves. The present utility model is a clipped-cloth advertisement display device.

However, prior art has the following adequacies:

(1) Light boxes are often used as display mechanisms for advertising and promotion to for better display effects. The fabrication processes of prior art light boxes are conventional and inconvenient and the sizes of light boxes cannot be enlarged or reduced anytime based on the area of the advertising cloth, and this compromises the practicality of prior art light boxes.

(2) Methods for installation and fastening of prior art stretched-cloth light boxes are too complicated and the costs and material consumption for installation, maintenance and drawing cloth replacement are too high.

SUMMARY OF THE UTILITY MODEL

(1) Technical Problems Resolved

In order to overcome the inadequacies of prior art, the present utility model aims to resolve the problems associated with the complexity of light box assembly/disassembly and the cumbersomeness of drawing cloth installation by providing a clipped-cloth advertisement display device.

(2) Technical Scheme

To this end, the present utility model provides the following technical scheme: a clipped-cloth advertisement display device comprising a second three-way elbow, wherein: one end of the second three-way elbow is connected to a first transverse tube, one end of the first transverse tube is connected to a second sleeve tube by means of a spring clasp, the upper end of the second three-way elbow is connected to a first sleeve tube, the upper end of the first sleeve tube is connected to a first vertical tube by means of a spring clasp, the upper end of the first vertical tube is connected to a first three-way elbow, one end of the first three-way elbow is connected to a second transverse tube, one end of the second transverse tube is connected to a fourth sleeve tube by means of a spring clasp, one end of the fourth sleeve tube is connected to a fourth three-way elbow, one end of the first three-way elbow is connected to a fifth three-way elbow by means of a first connecting tube, one end of the fifth three-way elbow is connected to a fourth transverse tube, one end of the fourth transverse tube is connected to an eighth sleeve tube by means of a spring clasp, one end of the eighth sleeve tube is connected to an eighth three-way elbow, the bottom end of the eighth three-way elbow is connected to a fourth vertical tube, the bottom end of the fourth vertical tube is connected to a seventh sleeve tube by means of a spring clasp, the bottom end of the seventh sleeve tube is connected to a seventh three-way elbow, one end of the seventh three-way elbow is connected to a sixth sleeve tube, one end of the sixth sleeve tube is connected to a third transverse tube, and one end of the third transverse tube is connected to a sixth three-way elbow.

Preferably, the bottom end of the fourth three-way elbow is connected to a second vertical tube, the bottom end of the second vertical tube is connected to a third sleeve tube by means of a spring clasp, the bottom end of the third sleeve tube is connected to a third three-way elbow, one end of the third three-way elbow is fixedly connected to the second sleeve tube, and one end of the fourth three-way elbow is connected to the eighth three-way elbow by means of a fourth connecting tube.

Preferably, the bottom end of the fifth three-way elbow is connected to a third vertical tube, and the bottom end of the third vertical tube is connected to a fifth sleeve tube by means of a spring clasp.

Preferably, one end of the seventh three-way elbow is fixedly connected to the third three-way elbow by means of a third connecting tube.

Preferably, the upper end of the sixth three-way elbow is fixedly connected to the fifth sleeve tube, and one end of the sixth three-way elbow is fixedly connected to the second three-way elbow by means of a second connecting tube.

Preferably, the first vertical tube, the first sleeve tube, the first transverse tube, the second sleeve tube, the third sleeve tube, the second vertical tube, the second transverse tube, the fourth sleeve tube, the first connecting tube, the second connecting tube, the third connecting tube, the fourth connecting tube, the third vertical tube, the fifth sleeve tube, the third transverse tube, the sixth sleeve tube, the seventh sleeve tube, the fourth vertical tube, the eighth sleeve tube and the fourth transverse tube are all provided with grooves.

(3) Beneficial Effects

The clipped-cloth advertisement display device provided by the present utility model has the following beneficial effects:

(1) The provision of the first three-way elbow, the second three-way elbow, the third three-way elbow, the fourth three-way elbow, the fifth three-way elbow, the sixth three-way elbow, the seventh three-way elbow and the eighth three-way elbow results in installation simplicity, non-requirement of proprietary fastening mechanism, self-fastening, capability of being heightened and shortened anytime, high practicality and suitability for use with drawing cloths of various dimensions, thereby effectively resolving the problems associated with the complexity of light box assembly/disassembly. One end of the second three-way elbow is connected to a first transverse tube, one end of the first transverse tube is connected to a second sleeve tube by means of a spring clasp, the upper end of the second three-way elbow is connected to a first sleeve tube, the upper end of the first sleeve tube is connected to a first vertical tube by means of a spring clasp, the upper end of the first vertical tube is connected to a first three-way elbow, one end of the first three-way elbow is connected to a second transverse tube, one end of the second transverse tube is connected to a fourth sleeve tube by means of a spring clasp, one end of the fourth sleeve tube is connected to a fourth three-way elbow, the bottom end of the fourth three-way elbow is connected to a second vertical tube, the bottom end of the second vertical tube is connected to a third sleeve tube by means of a spring clasp, the bottom end of the third sleeve tube is connected to a third three-way elbow, one end of the third three-way elbow is fixedly connected to the second sleeve tube, one end of the fourth three-way elbow is connected to the eighth three-way elbow by means of a fourth connecting tube, one end of the first three-way elbow is connected to a fifth three-way elbow by means of a first connecting tube, one end of the fifth three-way elbow is connected to a fourth transverse tube, one end of the fourth transverse tube is connected to an eighth sleeve tube by means of a spring clasp, the bottom end of the fifth three-way elbow is connected to a third vertical tube, the bottom end of the third vertical tube is connected to a fifth sleeve tube by means of a spring clasp, one end of the eighth sleeve tube is connected to an eighth three-way elbow, the bottom end of the eighth three-way elbow is connected to a fourth vertical tube, the bottom end of the fourth vertical tube is connected to a seventh sleeve tube by means of a spring clasp, the bottom end of the seventh sleeve tube is connected to a seventh three-way elbow, one end of the seventh three-way elbow is fixedly connected to the third three-way elbow by means of a third connecting tube, one end of the seventh three-way elbow is connected to a sixth sleeve tube, one end of the sixth sleeve tube is connected to a third transverse tube, one end of the third transverse tube is connected to a sixth three-way elbow, the upper end of the sixth three-way elbow is fixedly connected to the fifth sleeve tube, and one end of the sixth three-way elbow is fixedly connected to the second three-way elbow by means of a second connecting tube. In this way, an integral assembly is carried out and subsequent disassembly is made easy. The present utility model has a considerably high stability without the need of additional fastening devices, and it can be installed fast and transported and packaged conveniently. The present utility model is advantaged by its high economic value, low cost and high practicality.

(2) The provision of grooves makes installation of drawing cloths much more convenient and simpler, and the entire mechanism does not require any fastening devices and is integrally formed. This effectively resolves the problems of cumbersome drawing cloth installation. The first vertical tube 9, the first sleeve tube 10, the first transverse tube 11, the second sleeve tube 12, the third sleeve tube 13, the second vertical tube 14, the second transverse tube 15, the fourth sleeve tube 16, the first connecting tube 17, the second connecting tube 18, the third connecting tube 19, the fourth connecting tube 20, the third vertical tube 21, the fifth sleeve tube 22, the third transverse tube 23, the sixth sleeve tube 24, the seventh sleeve tube 25, the fourth vertical tube 26, the eighth sleeve tube 27 and the fourth transverse tube 28 are provided with grooves 29, and these aluminum tubes made of aluminum sections can be easily dismantled and fixedly connected to the first three-way elbow 1, the second three-way elbow 2, the third three-way elbow 3, the fourth three-way elbow 4, the fifth three-way elbow 5, the sixth three-way elbow 6, the seventh three-way elbow 7 and the eighth three-way elbow 8, respectively. When installing drawing cloth, adhesive bars are fixed to the perimeter of the drawing cloth and the adhesive bars are then slotted into the grooves in the various aluminum tubes, respectively. This makes its installation easier and more convenient than stretch-cloth light box. Drawing cloth can be conveniently replaced by simply pulling the adhesive bars out of the grooves. This makes drawing cloth replacement faster and much more convenient.

In the figures: 1 denotes first three-way elbow; 2 denotes second three-way elbow; 3 denotes third three-way elbow; 4 denotes fourth three-way elbow; 5 denotes fifth three-way elbow; 6 denotes sixth three-way elbow; 7 denotes seventh three-way elbow; 8 denotes eighth three-way elbow; 9 denotes first vertical tube; 10 denotes first sleeve tube; 11 denotes first transverse tube; 12 denotes second sleeve tube; 13 denotes third sleeve tube; 14 denotes second vertical tube; 15 denotes second transverse tube; 16 denotes fourth sleeve tube; 17 denotes first connecting tube; 18 denotes second connecting tube; 19 denotes third connecting tube; 20 denotes fourth connecting tube; 21 denotes third vertical tube; 22 denotes fifth sleeve tube; 23 denotes third transverse tube; 24 denotes sixth sleeve tube; 25 denotes seventh sleeve tube; 26 denotes fourth vertical tube; 27 denotes eighth sleeve tube; 28 denotes fourth transverse tube; 29 denotes groove; and 30 denotes spring clasp.

DETAILED DESCRIPTION

The present utility model will be described in further detail below with reference to the accompanying drawings and the technical solutions thereof. It is apparent that the embodiments described are merely some but not all embodiments of the present utility model. Therefore, all other embodiments obtained by persons skilled in the art based on the embodiments hereof without creative labor shall fall within the scope of protection of the present utility model.

Figure 1:
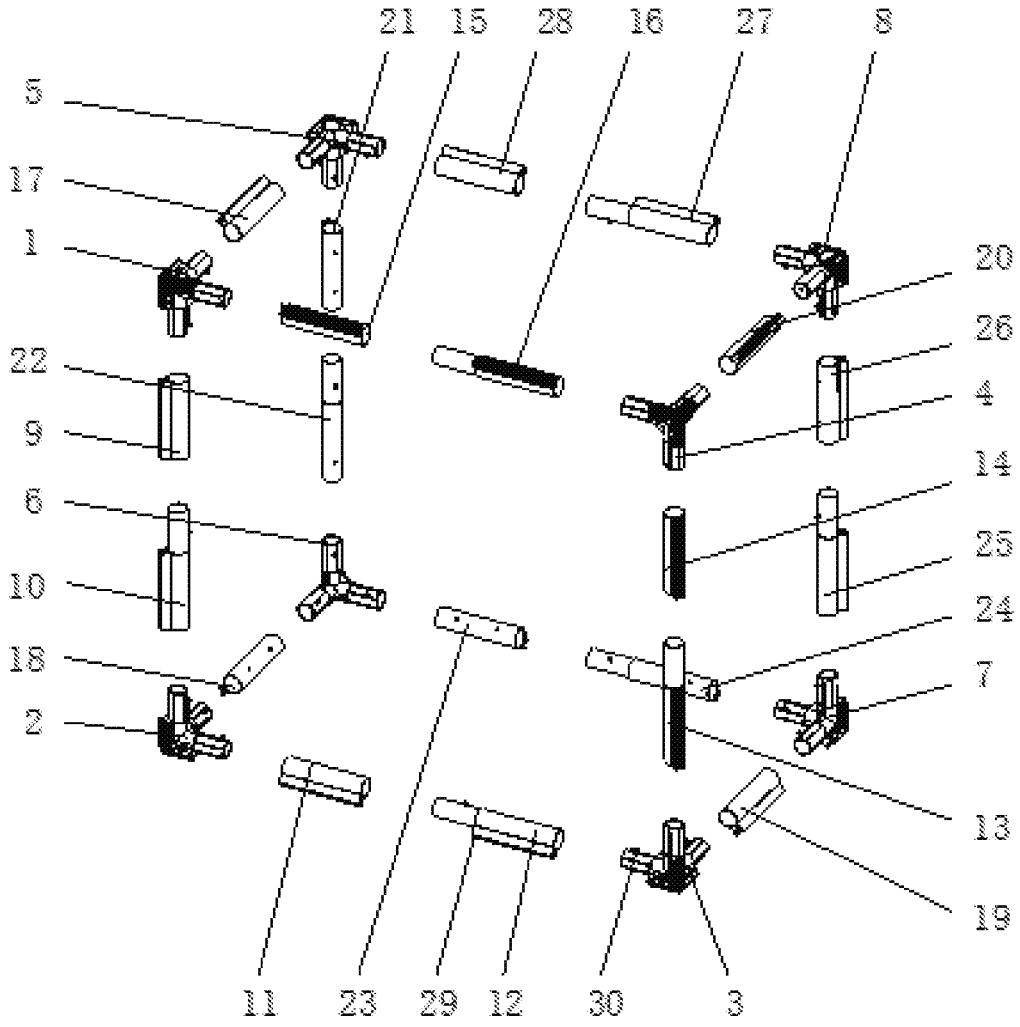
FIG. 1 is an exploded structural schematic of the present utility model.
Figure 2:
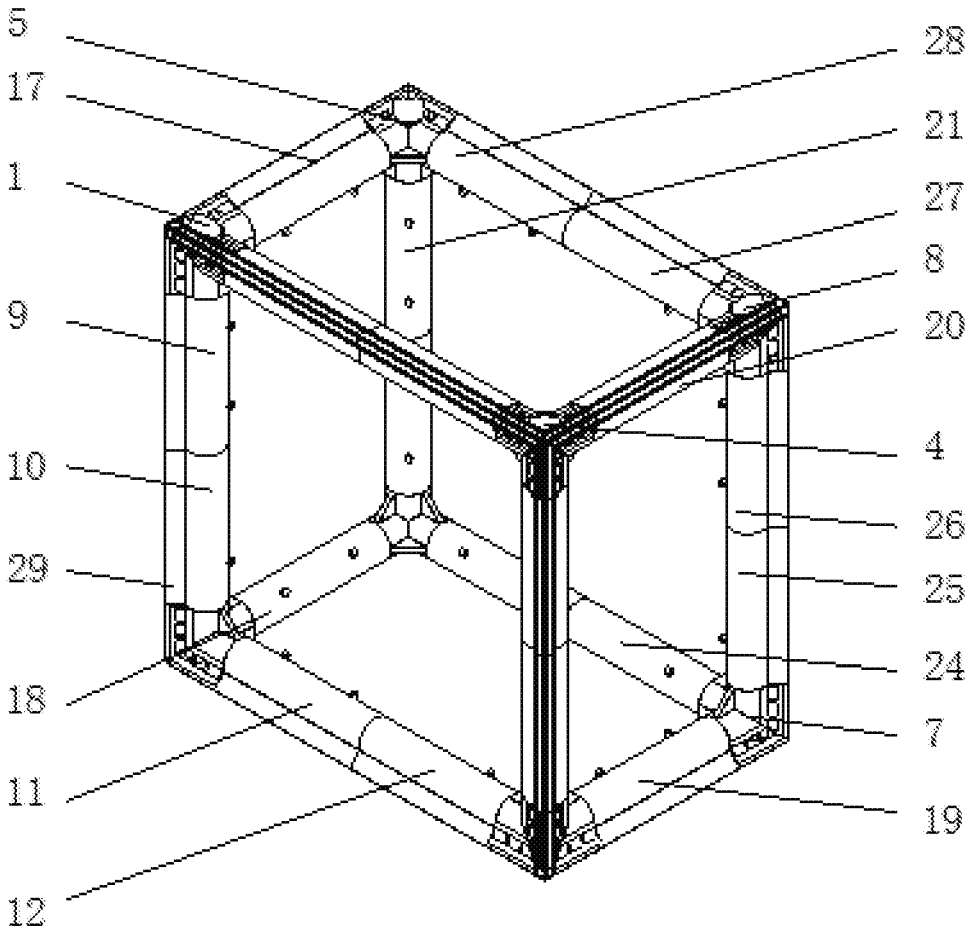
FIG. 2 is an isometric view of the present utility model.
Figure 3:
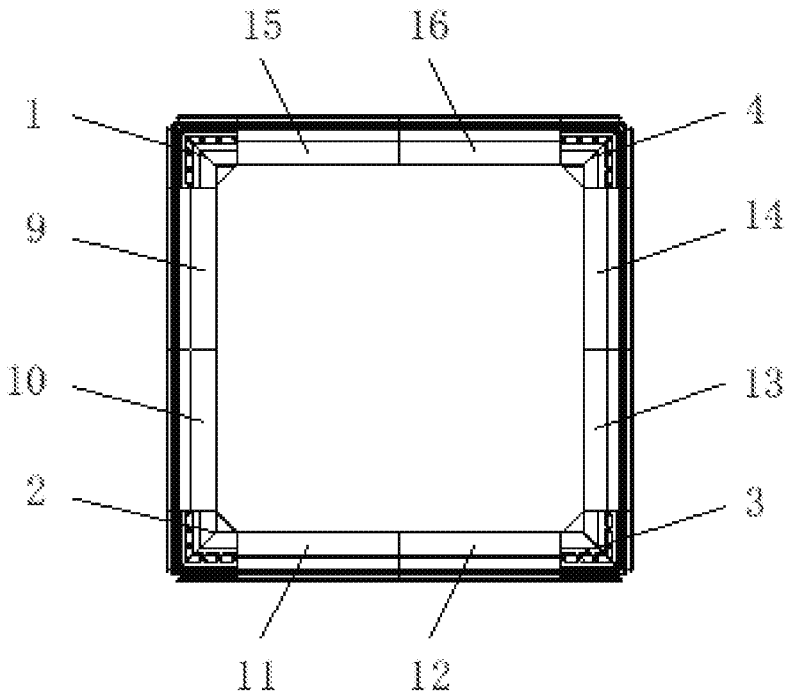
FIG. 3 is a front view of the present utility model.
Figure 4:
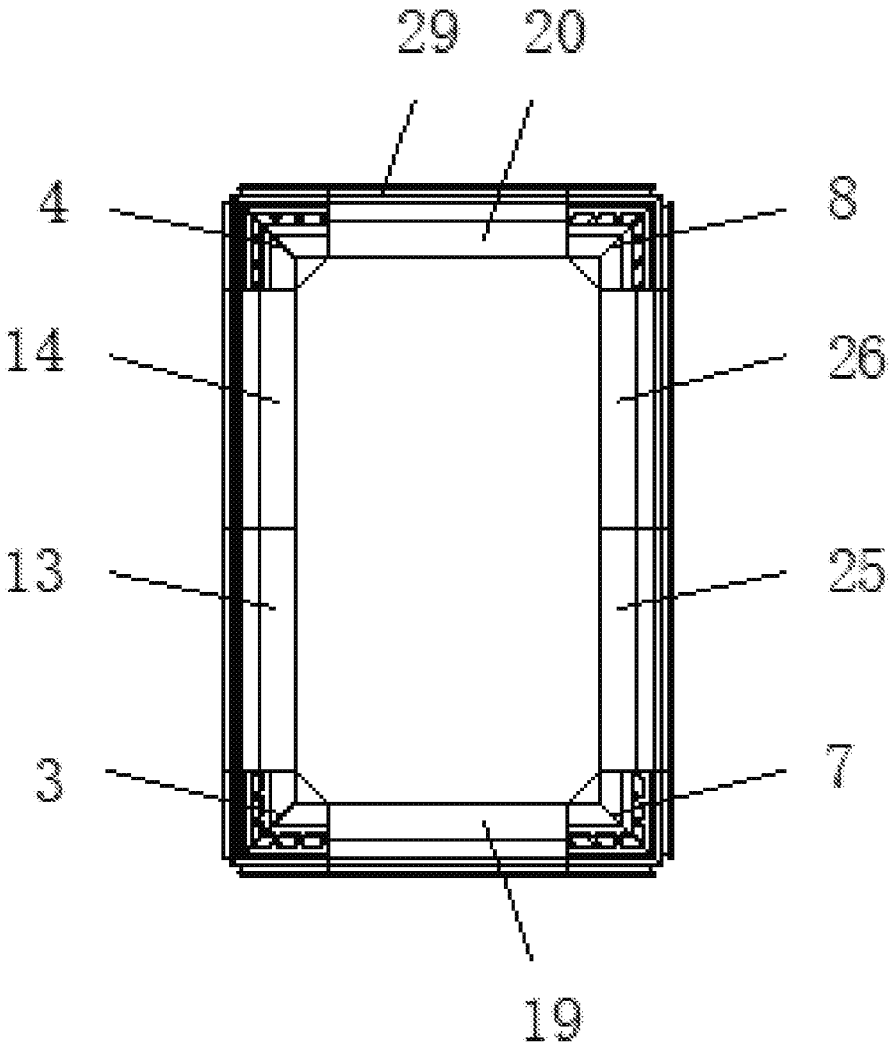
FIG. 4 is a right view of the present utility model.

With reference to FIGS. 1-4, the present utility model provides a technical scheme as follows: a clipped-cloth advertisement display device comprising a second three-way elbow 2, wherein: one end of the second three-way elbow 2 is connected to a first transverse tube 11, one end of the first transverse tube 11 is connected to a second sleeve tube 12 by means of a spring clasp 30, the upper end of the second three-way elbow 2 is connected to a first sleeve tube 10, the upper end of the first sleeve tube 10 is connected to a first vertical tube 9 by means of a spring clasp 30, the upper end of the first vertical tube 9 is connected to a first three-way elbow 1, one end of the first three-way elbow 1 is connected to a second transverse tube 15, one end of the second transverse tube 15 is connected to a fourth sleeve tube 16 by means of a spring clasp 30, one end of the fourth sleeve tube 16 is connected to a fourth three-way elbow 4; the bottom end of the fourth three-way elbow 4 is connected to a second vertical tube 14, the bottom end of the second vertical tube 14 is connected to a third sleeve tube 13 by means of a spring clasp 30, the bottom end of the third sleeve tube 13 is connected to a third three-way elbow 3, one end of the third three-way elbow 3 is fixedly connected to the second sleeve tube 12, and one end of the fourth three-way elbow 4 is connected to the eighth three-way elbow 8 by means of a fourth connecting tube 20; one end of the first three-way elbow 1 is connected to a fifth three-way elbow 5 by means of a first connecting tube 17, one end of the fifth three-way elbow 5 is connected to a fourth transverse tube 28, one end of the fourth transverse tube 28 is connected to an eighth sleeve tube 27 by means of a spring clasp 30; the bottom end of the fifth three-way elbow 5 is connected to a third vertical tube 21, and the bottom end of the third vertical tube 21 is connected to a fifth sleeve tube 22 by means of a spring clasp 30; one end of the eighth sleeve tube 27 is connected to an eighth three-way elbow 8, the bottom end of the eighth three-way elbow 8 is connected to a fourth vertical tube 26, the bottom end of the fourth vertical tube 26 is connected to a seventh sleeve tube 25 by means of a spring clasp 30, the bottom end of the seventh sleeve tube 25 is connected to a seventh three-way elbow 7; one end of the seventh three-way elbow 7 is fixedly connected to the third three-way elbow 3 by means of a third connecting tube 19; one end of the seventh three-way elbow 7 is connected to a sixth sleeve tube 24, one end of the sixth sleeve tube 24 is connected to a third transverse tube 23, and one end of the third transverse tube 23 is connected to a sixth three-way elbow 6; the upper end of the sixth three-way elbow 6 is fixedly connected to the fifth sleeve tube 22, and one end of the sixth three-way elbow 6 is fixedly connected to the second three-way elbow 2 by means of a second connecting tube 18. In this way, an integral assembly is carried out and subsequent disassembly is made easy. The present utility model has a considerably high stability without the need of additional fastening devices, and it can be installed fast and transported and packaged conveniently. The present utility model is advantaged by its high economic value, low cost, high practicality, installation simplicity, non-requirement of proprietary fastening mechanism, self-fastening, capability of being heightened and shortened anytime, and suitability for use with drawing cloths of various dimensions. The first vertical tube 9, the first sleeve tube 10, the first transverse tube 11, the second sleeve tube 12, the third sleeve tube 13, the second vertical tube 14, the second transverse tube 15, the fourth sleeve tube 16, the first connecting tube 17, the second connecting tube 18, the third connecting tube 19, the fourth connecting tube 20, the third vertical tube 21, the fifth sleeve tube 22, the third transverse tube 23, the sixth sleeve tube 24, the seventh sleeve tube 25, the fourth vertical tube 26, the eighth sleeve tube 27 and the fourth transverse tube 28 are provided with grooves 29, and these aluminum tubes made of aluminum sections can be easily dismantled and fixedly connected to the first three-way elbow 1, the second three-way elbow 2, the third three-way elbow 3, the fourth three-way elbow 4, the fifth three-way elbow 5, the sixth three-way elbow 6, the seventh three-way elbow 7 and the eighth three-way elbow 8, respectively. When installing drawing cloth, adhesive bars are fixed to the perimeter of the drawing cloth and the adhesive bars are then slotted into the grooves 29 in the various aluminum tubes, respectively. This makes its installation easier and more convenient than stretch-cloth light box. Drawing cloth can be conveniently replaced by simply pulling the adhesive bars out of the grooves 29. This makes drawing cloth replacement faster and much more convenient. This being the case, the entire mechanism does not require any fastening devices and is integrally formed.

When in use, one end of the second three-way elbow 2 of the present utility model is connected to a first transverse tube 11 and a second sleeve tube 12, the upper end of the second three-way elbow 2 is connected to a first sleeve tube 10 and a first vertical tube 9, the upper end of the first vertical tube 9 is connected to a first three-way elbow 1, one end of the first three-way elbow 1 is connected to a second transverse tube 15 and a fourth sleeve tube 16, one end of the fourth sleeve tube 16 is connected to a fourth three-way elbow 4, the bottom end of the fourth three-way elbow 4 is connected to a second vertical tube 14 and a third sleeve tube 13, the bottom end of the third sleeve tube 13 is connected to a third three-way elbow 3, one end of the third three-way elbow 3 is fixedly connected to the second sleeve tube 12, one end of the fourth three-way elbow 4 is connected to the eighth three-way elbow 8 by means of a fourth connecting tube 20, one end of the first three-way elbow 1 is connected to a fifth three-way elbow 5 by means of a first connecting tube 17, one end of the fifth three-way elbow 5 is connected to a fourth transverse tube 28 and an eighth sleeve tube 27, the bottom end of the fifth three-way elbow 5 is connected to a third vertical tube 21 and a fifth sleeve tube 22, one end of the eighth sleeve tube 27 is connected to an eighth three-way elbow 8, the bottom end of the eighth three-way elbow 8 is connected to a fourth vertical tube 26 and a seventh sleeve tube 25, the bottom end of the seventh sleeve tube 25 is connected to a seventh three-way elbow 7, one end of the seventh three-way elbow 7 is fixedly connected to the third three-way elbow 3 by means of a third connecting tube 19, one end of the seventh three-way elbow 7 is connected to a sixth sleeve tube 24 and a third transverse tube 23, one end of the third transverse tube 23 is connected to a sixth three-way elbow 6, the upper end of the sixth three-way elbow 6 is fixedly connected to the fifth sleeve tube 22, one end of the sixth three-way elbow 6 is fixedly connected to the second three-way elbow 2 by means of a second connecting tube 18. In this way, an integral assembly is carried out that makes installation of the present utility model simple. The present utility model is capable of being heightened and shortened anytime, and is suitable for use with drawing cloths of various dimensions. The first vertical tube 9, the first sleeve tube 10, the first transverse tube 11, the second sleeve tube 12, the third sleeve tube 13, the second vertical tube 14, the second transverse tube 15, the fourth sleeve tube 16, the first connecting tube 17, the second connecting tube 18, the third connecting tube 19, the fourth connecting tube 20, the third vertical tube 21, the fifth sleeve tube 22, the third transverse tube 23, the sixth sleeve tube 24, the seventh sleeve tube 25, the fourth vertical tube 26, the eighth sleeve tube 27 and the fourth transverse tube 28 are provided with grooves 29. When installing drawing cloth, adhesive bars are fixed to the perimeter of the drawing cloth and the adhesive bars are then slotted into the grooves 29 in the various aluminum tubes, respectively.

It can be seen from the above that the present utility model is capable of resolving the problems associated with the complexity of light box assembly/disassembly and the cumbersomeness of drawing cloth installation by providing the first three-way elbow 1, the second three-way elbow 2, the third three-way elbow 3, the fourth three-way elbow 4, the fifth three-way elbow 5, the sixth three-way elbow 6, the seventh three-way elbow 7, the eighth three-way elbow 8 and the grooves 29.

It must be noted that relational terminologies such as "first" and "second" used herein are merely intended to differentiate one entity or operation from another entity or operation, and do not require these entities or operations to have any actual relation or sequence. Also, terms such as "comprise", "include" or other variants are intended to cover non-exclusive inclusion, thereby making processes, methods, articles or equipment that include a series of essential factors not only include those essential factors but also include other essential factors which are not explicitly enumerated, or further include the inherent factors of these processes, methods, articles or equipment.

While the foregoing has illustrated and described preferred embodiments of the present utility model, it will be understood by persons of ordinary skill in the art that variations, alterations, substitutions and modifications may be made to these embodiments without departing from the spirit and principles of the present utility model, and the scope of the present utility model shall be defined by the appended claims and their equivalents.

What is claimed:

1. A graphics advertisement display apparatus, comprising:

a first three-way elbow associated with a second transverse tube, a first vertical sleeve tube and a first connecting tube;

a second three-way elbow connected to a first grooved sleeve tube, a first transverse tube and a second connecting tube;

a third three-way elbow associated with a second grooved sleeve tube, a third grooved sleeve tube and a third connecting tube;

a fourth three-way elbow associated with a second vertical tube, a fourth connecting tube and a fourth grooved sleeve tube;

a fifth three-way elbow associated with the first connecting tube, a third vertical tube and a fourth transverse tube;

a sixth three-way elbow associated with a fifth grooved sleeve tube, a third transverse tube and the second connecting tube;

a seventh three-way elbow associated with a sixth sleeve tube, a seventh sleeve tube, and the third connecting tube; and an eighth three-way elbow associated with an eighth sleeve tube, a fourth vertical tube and the fourth connecting tube, wherein a pliable advertisement is received by the at least one of the first grooved sleeve tube, the second grooved sleeve tube, the third grooved sleeve tube, the fourth grooved sleeve tube and the fifth grooved sleeve tube, wherein each grooved sleeve tube comprises a groove integrated within the sleeve tube, wherein the first transverse tube, the second transverse tube, the third transverse tube and the fourth transverse tube each have a first end having a diameter sized to be received respectively by an end of each of the first connecting tube, the second connecting tube, the third connecting tube and the fourth connecting tube.

2. The graphic advertising display of claim 1, wherein the first transverse tube, the second transverse tube and the third transverse tube further comprise a groove.

3. The graphic advertising display of claim 1, wherein the first transverse tube is sized to conform with the second sleeve tube.

4. The graphic advertising display of claim 1, wherein the second transverse tube is sized to conform with the fourth sleeve tube.

5. The graphic advertising display of claim 1, wherein the third transverse tube is sized to conform with the sixth sleeve tube.

6. The graphic advertising display of claim 1, wherein the first vertical tube, the second vertical tube, the third vertical tube and the fourth vertical tube further comprise a groove.

7. The graphic advertising display of claim 1, wherein the first vertical tube is sized to conform with the first grooved sleeve tube.

8. The graphic advertising display of claim 1, wherein the second vertical tube is sheathed to conform with the third grooved sleeve tube.

9. The graphic advertising display of claim 1, wherein the third sheathed transverse tube is sized to conform with the sixth grooved sleeve tube.

10. The graphic advertising display of claim 1, wherein the fourth sheathed transverse tube is sized to conform with the eighth grooved sleeve tube.

11. The graphic advertising display of claim 1, wherein a pliable advertising display is received by the at least one of the first grooved sleeve tube, the second grooved sleeve tube, the third grooved sleeve tube, the fourth grooved sleeve tube and the fifth grooved sleeve tube.

* * * * *